US005275348A

United States Patent [19]

Looser

[11] Patent Number: 5,275,348

[45] Date of Patent: Jan. 4, 1994

[54] WEB WINDING DRIVE CONTROL METHOD

[76] Inventor: Gottlieb Looser, In der Finne 910, FL-9496 Balzers, Liechtenstein

[21] Appl. No.: 509,796

[22] Filed: Apr. 17, 1990

[30] Foreign Application Priority Data

Apr. 21, 1989 [CH] Switzerland ..... 1526/89-1

[51] Int. Cl.[5] ..... B65H 23/198; B65H 77/00

[52] U.S. Cl. ..... 242/75.51; 242/65

[58] Field of Search ..... 242/75.51, 75.2, 65, 242/75.52, 75.53

[56] References Cited

U.S. PATENT DOCUMENTS

| | | | |
|---|---|---|---|
| 4,159,808 | 7/1979 | Meihofer | 242/75.51 |
| 4,191,341 | 3/1980 | Looser | 242/56 A |
| 4,347,993 | 9/1982 | Leonard | 242/75.51 |
| 4,508,284 | 4/1985 | Kataoka | 242/75.51 |
| 4,634,069 | 1/1987 | Kataoka | 242/75.51 |

*Primary Examiner*—Daniel P. Stodola
*Assistant Examiner*—John Q. Nguyen
*Attorney, Agent, or Firm*—Wigman, Cohen, Leitner & Myers

[57] ABSTRACT

A method of winding a web of a polymer film having lateral edges onto a sequence of winding cores to form a sequence of web coils comprising guiding said web by a deflection roller onto a winding drum and then onto a web take-up where the web coils are formed; the winding drum and the take-up each being provided with separate drives for rotating the winding drum and the web coils and for generating a tensile force that acts on said web; the winding drum has a central axis of rotation and a cylindrical contact surface for frictional and essentially non-slipping engagement with the web along a dynamic segment of the contact surface; this segment has a width defined by the web edges and a length defined by a first and a second end line, both extending transversely on the contact surface and parallel to the axis of rotation; the method further comprising continuously monitoring a first value of the tensile force that acts upon the web at the first end line and a second value of said tensile force acting upon the web at the second end line; the drive of the take-up is controlled by the values of the tensile force to obtain a generally smooth appearance of the surface and the end faces of the web coils.

An apparatus is disclosed for carrying out the novel method.

13 Claims, 2 Drawing Sheets

WEB WINDING DRIVE CONTROL METHOD

BACKGROUND OF THE INVENTION

1. Field of the Invention

This invention relates to the art of processing endless webs of flexible materials such as typically polymer films or fibrous materials including nonwovens by continuously winding the moving web onto a sequence of winding cores to produce a sequence of web coils to facilitate handling, storing and further processing of the web material.

2. Description of the Prior Art

Methods and apparatus means for this purpose are well known in the art as disclosed e.g. in U.S. Pat. No. 4,191,341 (EP 17,277) or the references discussed therein and are frequently termed "winders", "web winding machines" or—if used for this specific purpose—"film winders".

A common feature or aim of the more advanced prior art winding methods is that relatively fast-moving webs (e.g. at web speeds of 30 to 300 meters/minute), such as polymer webs emanating from sheet extruders, blow tube extruders or web-processing lines must be wound up continuously, i.e. without interrupting the web stream, to produce an "endless" sequence of coils or web rolls. Generally, empty cores, typically in the form of cardboard tubes, are supplied from a magazine to a start-up winding position or "first station" and made to rotate therein while the web that is still being wound onto the preceding coil is in the main winding position or "second station". Now, the web will be cut transversely to terminate the preceding coil; the "trailing end" of the proceding web section will be on the top surface of that coil. The "leading end" of the subsequent web section is made to be picked up by the empty core in the start-up winding position or station (e.g. by an adhesive or electrostatic charge) while the preceding coil is discharged from the "actual" or main winding position. Then, the "start-up" coil produced in the start-up winding position is transferred without interrupting the winding operation into the main winding position and remains there until that coil has reached its predetermined volume and is terminated by again transversely cutting the web. This sequence from start-up to coil discharge is termed "winding cycle".

Rotation of the cores or of the web coils formed thereon can be achieved by a frictional contact between the coil surface and a driven winding drum in contact with the coil surface (winders of the circumferential or friction type) and/or by a separate drive that actuates the coil, e.g. by rotating its core (termed center winding).

In the first instance, a sufficient contact pressure must exist between the coil and the winding drum and such pressure ("line pressure") should be controllable since different pressures may be needed for different materials and/or different stages of coil completion.

In the second instance no such pressure is employed but a corresponding tractive power of the drive for the coil is used for winding.

Whether a given film web is more expediently processed using a friction winder or using a center winder usually depends on the material properties or the surface properties of the web material, e.g. polymer, and combination machines ("universal" or "multimode" winders) have been disclosed in the above cited art. Such machines are capable of operating either in the friction winding mode and/or in the central winding mode and provide for improved processing or improved economy.

A disadvantage of the prior art universal winders is that the so-called coil finish, that is to say the quality of the finished coil (typically having diameters of 100 to 1000 mm and widths of 5 to 3000 mm) may differ substantially depending on the polymer web material processed and on the operating mode of the winder by friction or center drive.

In order to control the linear pressure at the nip between the coil and the winding drum in the range of from a "zero pressure" and a predetermined positive contact pressure, the multimode winder disclosed in European Patent 17,277 is provided with a force sensor that permits measurement of the pressure exerted by the coil onto the winding drum; then, the contact pressure values thus determined are used to operate a compensator, e.g. a hydraulic cylinder, so as to keep the pressure between the winding drum and the wound coil at a desired predetermined or programme-controlled value, independently of the increasing weight of the supported coil pressing against the winding drum. The coil is supported "dynamically", i.e. held by a pair of arms in an angular position rather than "statically", i.e. supported in vertical direction.

Now, in order to control and maintain those winding conditions as are needed for a satisfactory coil finish with a given web material and notably for maintaining optimum conditions even though the diameter and the weight of the coil will increase during winding, winding operations required that the linear pressure to be maintained between the coil and the winding drum (in the nip), on the one hand, and the tensile force exerted in the web while moving onto the coil, on the other hand, be determined experimentally for each type of web material and each web thickness, and the values thus obtained must be used for computer-controlled operation of the winder.

In other words, the parameters of the winding operation are determined by a given programme that sets and regulates winding conditions for any given web. Thus, true control in the sense of measuring the actual critical parameters of operation and adjusting them as required for optimum coil finish is not possible with such systems.

OBJECTS OF THE INVENTION

When reviewing the causes of the limitations of computer-controlled (actually: programme-controlled) winder operation, it appeared that the lack of direct feedback of actual working parameters into process control is a main reason for an unsatisfactory coil finish of multi-mode winder operation by computer programmes, notably when processing so-called "problem films" as explained in more detail below, aside from the expenses and capital costs involved in computer control of multi-mode winders. Specifically, I have found, inter alia, that conventional computer-controlled operation is not capable to compensate for losses in the drive systems caused by different or differing operating speeds or by variations of the line pressure between the winding drum and a coil in contact therewith.

Accordingly, it is a main object of the present invention to provide for multi-mode winding operation that avoids the limitations and costs of computer-controlled winder operation and yields a consistent high-quality coil finish even when processing webs of polymers known to cause problems in continuous high-speed winding operations.

Another essential object of the invention is significantly improved line pressure control in the operation of high-speed multi-mode winders.

SUMMARY OF THE INVENTION

I have found that the above objects will be achieved and that further advantages can be attained by my novel method of continuously winding a moving web of a flexible material such as typically a polymer film and having two substantially parallel lateral edges onto a sequence of winding cores, e.g. of the conventional cardboard-tube type, to form an essentially endless (i.e. number defined by length of web) sequence of web coils each having a coil finish which is substantially determined by the smoothness quality of the cylindrical outer coil surface and of the two end faces formed by the superimposed coiled lateral web edges of the coil; the method according to the invention comprises guiding the web by means of a deflection roller onto a winding drum and subsequently onto a web take-up means, e.g. a conventional main or second winding station of a multi-mode winder for centrally driving the coil mandrel; both the winding drum and the take-up means must be operatively connected with dedicated drives for individually (i.e. capable of individual control) rotating the winding drum and the web coil, and for generating a controlled tensile force acting on the web; the winding drum has a cylindrical contact surface for frictional and non-slipping web engagement along a dynamic segment of the contact surface; by "dynamic" segment I refer to the momentaneous area of contact between the moving web and the rotating drum such that the general shape of the segment will remain essentially constant over time even though the actual surface portions engaged at the interface will change continuously; this dynamic segment has a width defined by the distance between mutually opposed points (i.e. transversely relative to the longitudinal extension of the moving web) on the lateral web edges and a length (i.e. in longitudinal web direction) defined by a first and a second end line, each extending transversely on the contact surface and each being substantially parallel to the (theoretical) axis of rotation of the winding drum; according to a main characterizing feature, my novel method further comprises continuously monitoring or measuring a first value of the tensile force in the web along the first end line, and a second tensile force value in the web along the second end line; both the first and the second value are used to control the drive that rotates the coil to obtain an optimum coil finish as explained above.

As indicated above, the invention is not only concerned with the method aspect just explained but also relates to a novel apparatus for carrying out the method.

Generally speaking, the inventive apparatus serves to continuously wind a moving web of a flexible material as explained above onto a sequence of winding cores to form an indefinite sequence of web coils; the apparatus comprises an essentially horizontal cylindrical winding drum having a surface for frictional and non-slipping engagement with the web, e.g. covered with a resilient polymer; the drum is connected to a drive for rotation of the drum; a deflection roller is positioned upstream (i.e. removed from the coil-side of the drum) from and near or next to the drum and a web take-up device of the type used as the main winding position or station in conventional multi-mode winders downstream from and next to the winding drum; the take-up device is in operative connection with a drive for rotating motion of that winding core which is engaged in the take-up device; further, the apparatus comprises monitoring means, e.g. pressure sensors or transducers of the type known per se, for continuously monitoring a first tensile force in the web between the coil and the winding drum, as well as for continuously monitoring a second tensile force in the web between the winding drum and the deflection roller; the apparatus comprises a means for controlling the power input of the web-coiling drive in response to the continuously monitored tensile forces for maintaining the tensile force of the web between the winding drum and the coil at a desired value that is independent from the tensile force in the web between the winding drum and the deflection roller.

DISCUSSION OF PREFERRED EMBODIMENTS

In a first preferred embodiment of the inventive method the first and the second end line that determine the length of the dynamic segment explained above are located distanced from each other in an essentially horizontal common plane that extends through the axis of rotation of the winding drum. In other words, it is generally preferred that the end lines of the dynamic segment are substantially in the 3 o'clock and in the 9 o'clock positions, i.e. peripherally distanced by about 180° (360° assumed for complete circle). Preferably, the first tensile force value between the drum and the coil is monitored by measuring the "net" bearing pressure of the winding drum, i.e. the force exerted by the winding drum upon its bearings minus the weight of the drum. For many types of web it is preferred that the coil, when in the main winding position, should be in pressure contact with the winding drum, at a controlled linear pressure, during at least a portion of the winding cycle of each coil.

In a preferred embodiment of the inventive apparatus the web coil is supported "statically" as explained above, i.e. is mounted on a vertical support; a means for altering the distance between winding drum and coil in response to an increase of the coil diameter, e.g. a linear drive, is a normally preferred further feature of the inventive apparatus. The winding drum may be mounted on a first carriage which in turn is supported by a second carriage that is displaceable relative to the coil for roughly positioning the winding drum by movement of the second carriage; fine control of the position of the winding drum will then be effected by movement of the first carriage.

The apparatus of the invention may advantageously comprise a device for pressing the winding drum onto an adjacent coil surface at a predetermined or controlled line pressure which, according to the present invention, is preferably in the range of from about zero bar to about 10 bar with a maximum deviation from a selected contact pressure value of less than 30 mbar above or below the selected values and independent from the increasing coil diameter. Conventional pressure sensors or transducers can be used to monitor or measure the tensile forces of interest, e.g. by providing such sensors in operative connection with the winding drum, the bearing or bearings thereof, or any other structure that supports the winding drum; again, it is the "net" value, i.e. the pressure minus the weight, that is of interest here since such net value is assumed to be proportional to the tensile force exerted by the web.

A preferred device for pressing the winding drum onto the coil surface is a membrane cylinder, notably a so-called "roll membrane cylinder" of the general type suitable for measuring barometric pressure where a relatively minor change of pressure causes a relatively large reactive motion.

BRIEF DESCRIPTION OF THE DRAWINGS

The invention will be better understood and objects other than those set forth above will become apparent when consideration is given to the following detailed description thereof. Such description makes reference to the annexed drawings wherein the same significant reference characters are used to denote the same or analogous components and wherein.

DETAILED DESCRIPTION OF THE PREFERRED EMBODIMENTS

Figure 1:
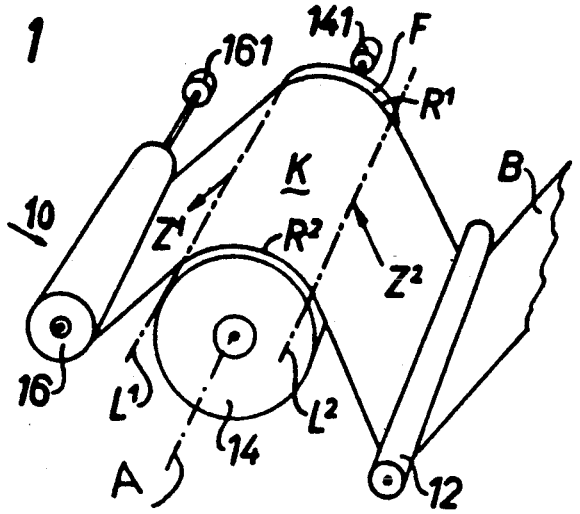
FIG. 1 is a perspective and diagrammatic view of the path of a web during winding to illustrate some major terms of the invention.

Describing now the drawings, it is to be understood that only enough of the elements involved in continuous web winding have been shown as needed for those skilled in the art to readily understand the underlying principles and concepts of the present invention while simplifying the drawings. Turning attention now specifically to FIG. 1 of the drawing the web B shown in perspective view comes from a plant (not shown) for the production of flexible plastic films from a material of the type used for film production, such as a homopolymeric or copolymeric film-forming thermoplastic, for example one based on polyalkylenes, such as polyethylene (PE) or polypropylene (PP), polyisobutylene (PIB), copolymers based on ethylene and vinyl acetate (EVA) or ethylene, styrene and acrylonitrile (ESA), and ionomers having acid side groups in free form or as salts, polyamides, (co)polyesters and other macromolecular synthetic or semisynthetic substances, including regenerated cellulose or cellulose derivatives, which are extrudable or capable of being processed by other method to give films.

The film production plants may accordingly be a blown tube extruder, a film casting plant, a sheet extruder or any other plant which is suitable for the production of flexible polymer or other types of uniform webs of relatively thin (e.g. up to about 0.5 mm gauge) flexible materials.

The film to be wound according to the invention may also be obtained by withdrawal from, or unwinding from, a film source, for example a stock film roll, film magazine, etc., or may be wound in the course of a processing procedure and may be obtained as a continuous semifinished product by, for example, a stretching, printing, coating or dyeing process or a similar process, which semifinished product is to be wound continuously on tubes for storage or for transport. The films may contain the additives conventionally used in film technology including plasticizers, dyes, pigments, stabilizers, lubricants, blocking agents or antiblocking agents, etc., and may be in any orientation state (amorphous, crystalline, monoaxially or biaxially oriented) or may be shrinkable.

In fact, winding of special films, for example the so-called "high-slip film" or the sticking "clingfilm", as used to secure goods on transport pallets, presents extreme problems with regard to roll finish owing to the extreme tendency to block, slip or shrink, for example clingfilms tending to exhibit subsequent shrinkage on the roll and accordingly making it necessary to carry out winding with no more than a low winding tension, that is to say low or almost zero tensile values $Z^1$, if they are to be prevented from changing subsequently through shrinkage to the point that they would become useless. On the other hand, high-slip films require a relatively high winding tension so that the finished rolls do not "telescope", that is to say, the layers of the roll should not shift with respect to one another.

Although the method according to the invention or the apparatus can be used for processing polymer films in all normally available thicknesses (typically between 5 and 500 micrometers, μm), the advantages of the invention may frequently be of particular value in the case of extremely thin films (5 to 50 um), because such films have a generally unsatisfactory or unusable roll finish in the case of inaccurately or incorrectly controlled winding tension values (tensile stress value $Z^1$).

As shown in FIG. 1, web B moving around the deflection roller 12 to winding drum 14 is under "web tension", that is to say, the tensile value $Z^2$ generated by drive 161 of the winding drum; this tensile stress should be sufficiently high to prevent sagging of the web between the various web guide and deflection means and to ensure smooth, vibration-free running of the film web to the winding drum, and depends on various parameters, including web thickness, web width and the material properties of the film-forming polymer material when subjected to tension or strain. Typical tensile stress values $Z^2$ are frequently in the range of from 20 to 200N or higher.

For a satisfactory coil finish of problem films of the above-mentioned type tensile stress values $Z^1$ between the winding drum 14 and the web roll or film roll 16 should be chosen independently of the web tension, that is to say, the tensile stress value $Z^2$, and should be capable of being maintained throughout winding. For many applications of the invention the tensile stress value $Z^1$ can be kept smaller than the value $Z^2$, or can be close to zero. On the other hand, it may be desirable for the value of $Z^1$ to be higher than that of $Z^2$; accordingly, usable values of $Z^1$ may be in the range of from about zero to about 200N or, in certain circumstances, even above the last-mentioned value.

Figure 2:
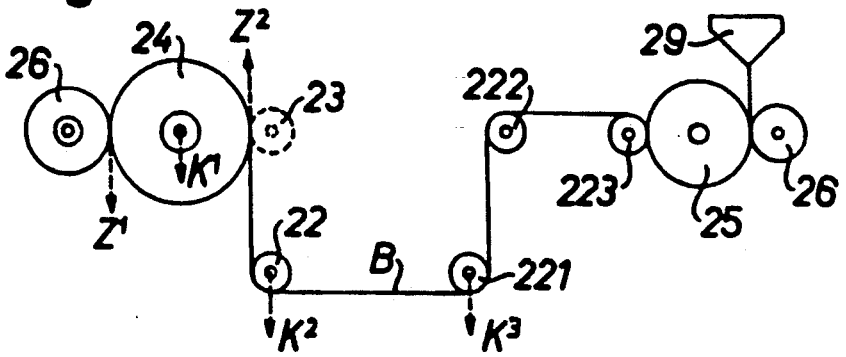
FIG. 2 is a diagrammatic side view of the path of a moving web from its production to winding as a coil by the method according to the invention.

Because of the necessity of choosing $Z^1$ independently of $Z^2$ it is believed to be important that the web or film web B is in frictional contact with the winding drum 14, i.e. has virtually no slip on the winding drum. If this frictional contact is not ensured, e.g. by the dimensions of the winding roller or by its operating parameters, such as, in particular, size or length of the contact surface or dynamic segment K or the coefficient of friction of the web material and the surface F of winding drum 14, a pressure roller (FIG. 2: 23) may be used in the region of the initial contact of the film web B with the winding drum 14 (FIG. 2: 24), the pressure exerted by the pressure roller being sufficient, together with the friction of web B on the contact surface K, to give virtually frictional no-slip coupling of web B with the surface of winding drum 14. The size of the contact surface K is determined, on the one hand, by the width of web B, that is to say, the distance between the web edges $R^1$ and $R^2$, and the peripheral length, that is to say, the length expediently stated in degrees of arc (full circle, 360°) of the lateral surface F of the cylinder (typically between 200 and 2000 mm for the stated diameter of the winding drum) between the two end lines $L^1$ and $L^2$. Their position depends, in turn, on the guidance of web B to and from winding drum 14, and the peripheral length of the contact surface K can in principle be increased to almost 360° by arranging appropriate deflection rollers. On the other hand, the peripheral length of the contact surface K could, in theory, be reduced almost to 0°. Peripheral lengths in the range of from between 45° and 270° can be used in practice, those in the range of from 90° to 230° and in particular those of about 180° being preferred for conventional diameters of winding drum 1 reasons explained in more detail below, a peripheral length of the contact surface K of about 180° is particularly preferred when web B runs virtually vertically from below onto the winding drum (as shown in FIG. 2), that is to say, the end line $L^2$ is in the "3 o'clock position", while $l^1$ is then radially opposite, that is to say, is in the "9 o'clock position". This is the case in particular when the contact line between the winding drum 14 (FIG. 2: 24) and the web roll or film roll 16 (FIG. 2: 26) coincides with $L^1$, as shown in FIG. 2. In this position of lines $L^1$ and $L^2$ with a peripheral spacing of about 180° changes in the tensile stress $Z^1$ and $Z^2$ result in a directly proportional change of the "weight", that is to say, the net bearing pressure of $K^1$, of the winding drum. If the bearing pressure $K^2$ of deflection roller 22 (and optionally to compensate the only 90° deflection at the deflection roller 22 also the bearing pressure K of the deflection roller 221) is continuously measured or monitored, the values of the tensile stresses $Z^1$ and $Z^2$ can be determined directly from the bearing pressures (for a known or tared weight of the winding drum 24 and of the deflection roller(s) 22 (and 221)); in this manner, control of the input power of drive 161 of web roll 16 as a function of the actual values of $Z^1$ and $Z^2$ determined in this way can be used to set and maintain a given value of $Z^1$ selected for optimal coil finish, automatic control of that value is required, that is to say, to keep it at the set-point value for optimal coil finish may be provided.

FIG. 2 shows, in a schematic lateral view, the path of web B from a casting container 29 having a slot-like outlet (not shown) around a cooling roller 25, optionally with a counter-roller 26, and around deflection rollers 223, 222, 221 (where a measurement K could be obtained) to the final deflection roller 22, that is to say, the deflection roller which is arranged "upstream" (the starting place or place of formation of film web B is regarded as the "source" of the "stream") when viewed from the winding drum 24 and which is adjacent to said drum. The measurement $K^2$ is obtained at the deflection roller 22 and, together with $K^1$, is used for controlling the drive power (torque) of the center drive (not shown in FIG. 2) of film roll 26 and hence for regulating the tensile stress value $Z^1$. As indicated, this value is frequently lower than the tensile stress value $Z^2$ but could be greater than this value and is, in any case, chosen and maintained independently thereof.

Figure 3:
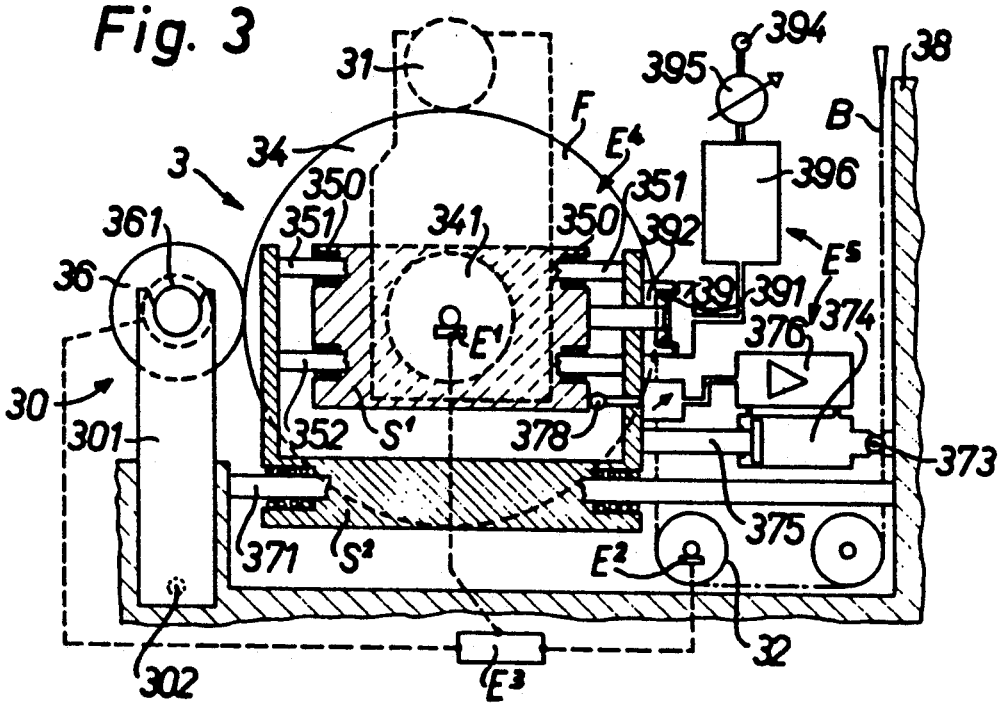
FIG. 3 is a schematic side view of a winder apparatus according to the invention.

Apparatus 3 shown schematically in FIG. 3 is supported on a frame 38 which also establishes the actual position of web take-up means 30. During the formation of web coil 36 under the controlled power of the center drive 361 bearing arm 301 is in the vertical position forming a "static" bearing as explained, in contrast to the dynamic bearing of the pivotable coil support arm of conventional multi-mode winders. Coupling 302 is not effective until after completion of a coil when the completed coil can be removed by swivelling arm 301 while winding of a fresh winding core 31 is initiated by frictional contact with surface F of winding drum 34 and transferred by arm 301.

Winding drum 34 preferably consists of light metal or a structural plastic since its mass should be kept as low as possible.

The vertical support of web coil 36 shown in FIG. 3 has the advantage that the weight increase of coil 36 upon continued winding will not have any adverse effects at all, for example an increased friction upon displacement or a slight sagging of arm 301. Winding drum 34 is driven by drum drive 341 (electric motor) and is mounted on a first carriage $S^1$ which can be displaced horizontally by means of ball bearings 350 on two rods or rails 351, 352. Rods 351, 352 are, in turn, part of a second carriage $S^2$ which—again mounted on ball bearings—can be displaced horizontally on rod or rail 371. Rail 371 is anchored in frame 38. Furthermore, a cylinder of a pneumatic or hydraulic cylinder/piston pair 374 is flanged with the frame 38 via coupling 373, the piston or plunger of said pair being connected to carriage $S^2$ via rod 375.

Control of the coarse positioning of the carriage $S^2$ can be effected in a manner known per se, e.g. by using a mechanical sensor 378 the contact or contact pressure of which at carriage $S^1$ results in a limited displacement of carriage $S^2$. Controls of this type are known per se and require no further explanation. Fine positioning of carriage $S^1$ and, hence, of winding drum 34 relative to winding station 30 or to coil 36 present therein is preferably effected by means of a conventional roll membrane cylinder 39. A compressed air reservoir 396 is kept by a source 394 at a predetermined over-pressure by means of control 395; the excess pressure, in turn, acts on roll membrane 391 and, via guide rod 392 connected thereto, presses winding drum 34 on carriage $S^1$ against the coil surface at a predetermined pressure.

Roll membrane cylinders of this type are known. Preferred and commercially available products offer control pressures of zero to 6 bar with a reproducibility of 0.02 bar.

In apparatus 3 of FIG. 3 the power (torque) of the center drive 361 of coil 36 is controlled as described above by means $E^1$, $E^2$ *l and* $E^3$ to regulatingly maintain a predetermined value of tensile stress $Z^1$ independently of tensile stress value $Z^2$, that is to say, dependent upon the actual value $Z^1$. The tensile stress between deflection roller 32 and winding drum 34 could, in principle, be measured in a conventional manner using a tensile stress sensor which presses a roller with a certain spring pressure against web B and measures the resulting deflection of the web. The tensile stress $Z^1$ (which is essential for a good coil finish) between coil 36 driven by motor 361 can, however, be measured in a conventional manner only with a loose web, but this is not possible if even a low defined contact pressure of winding drum 34 against the surface of coil 36 is to be maintained. For this reason means $E^1$ and $E^2$ preferably are conventional pressure sensors, the output signals of which will control power or torque of drive 361, generally an electric motor, of coil 36 via a comparator $E^3$ known per se and, thus, permit regulating control of tensile stress $Z^1$ at a desired set-point value. As described above, a preferred means $E^4$ for fine positioning of carriage $S^1$ includes a roll membrane cylinder, but other fine pressure controls could be used, for example a servo control means. The same considerations apply for means $E^5$, i.e. coarse pneumatic control. The method of guiding the carriages on rails is not critical and could be replaced, for example, by motor-driven spindles or the like.

EXAMPLES

The following examples and comparative examples serve to further illustrate the invention without limitation.

Examples 1 to 3 illustrate applications of the inventive method for winding films which are difficult to handle, with extremely poor qualities for achieving a satisfactory coil finish, such as, for example, films having a high lubricant content combined with an extremely low thickness and made, for example, of PE and containing ESA and antiblocking agents; another group of problematic webs are those having an increased tendency of adhesion such as, for example, containing PIB, as well as materials containing 6–8% of EVA which are known to have a high coefficient of friction.

With such problematic webs, all intermediate forms thereof with any film gauge encountered in practice, for example 12 to 250 μm, can, of course, also be wound according to the invention.

In the examples, a plant essentially corresponding to FIG. 3 was used in each case for winding films extruded in a conventional manner having a primary width of 1250 mm made from a tubular film die and which, after being trimmed, were cut into three webs each having a width of 400 mm.

In the production series described hereinbelow, the particular operating data of the automatic winding plant were recorded electronically. The quality of the resulting coils ("coil finish") was assessed on the basis of the following criteria and compared with results from computer-controlled winding machines; the operating speed n is noted in each case. The following criteria were evaluated:

a) surface of the completed coil;

b) hardness and pull-off properties of the film web from the coil;

c) dimensional stability of the coils; and d) quality of the end faces of the coils.

The results are shown in Table I.

EXAMPLE 1

Film webs consisting of PE and having a high content of PIB for achieving high adhesion and small thickness (15 μm) are wound at a speed of 80 m/min on a sequence of conventional winding cores as three parallel webs on cardboard tubes.

The bearing pressures of the winding drum with a net weight of 100 kg are measured (100 kg winding drum, 40N $Z^1$ and 60N $Z^2$) and the difference between the bearing pressure of the winding drum and that of the final deflection roller is adjusted to a set-point value of 60N.

The power consumption for operating drive 361 for the predetermined tension of 40N was recorded as 0.12 kW at the start of winding (core diameter 90 mm) to 0.2 kW at the end of winding (coil diameter 250 mm). The drive of winding drum 34 consumed 1.2 kW. The pressure of the winding drum against the coil was constant at 15N.

EXAMPLE 2

In the manner of example 1 a PE web enriched with ESA and antiblocking agent and having good sliding properties was wound. The web thickness was 35 μm, the winding tension $Z^1$ was 60N, web tension $Z^2$ was 70N, contact pressure was 35N, n=42 m/min.

EXAMPLE 3

A web of PE containing 6.5% EVA having high resilience was wound in the manner described above. Web thickness was 60 μm, winding tension $Z^1$ was 60N, web tension $Z^2$ was 60N, contact pressure was 20N, n=31 m/min.

EXAMPLE 4 (COMPARISON)

Using a computer-controlled winder of recent design as described, for example, in European Patent No. 0,017,277 the webs of examples 1 to 3 were wound; the effective data could not be measured directly because of system-dependent reasons.

The winding tension $Z^1$ was generated by means of predetermined motor power, that is to say, initial tension and input of tube diameter, and was constantly monitored by evaluating the difference between the speed of the winding drum motor and that of the central drive by means of computer evaluation, and the needed additional power was obtained by evaluating the tachometer signals during growth of the coil.

Power losses during force transmission cannot be compensated in this method.

Contact pressures, on the other hand, are measured directly with such a plant and the actual problem is evaluation of the signals obtained. A servo valve operating by means of metering an oil stream was used but the required sensitivity could not be achieved because of the incompressibility of the oil.

With all three web materials the set-point data were used as in the first three examples.

It was found that the uniformity of web tension and in particular of winding tension is extremely critical because even minor deviations led to uncontrolled tensions, both in positive and in negative direction, and defects of the coil finish.

The same lack of precision can also be assumed for the contact pressure of the winding drum which also has a significant effect upon coil finish.

TABLE I

| | | Winding tension controlled according to the invention | Computer-controlled winder according to EP 0 017 277 |
|---|---|---|---|
| | | Example 1 (sticking) | |
| a) | surface | good | good |
| b) | hardness + pull-off of film | good | satisfactory to good; initial winding tight owing to determination of tension by computer |
| c) | dimensional stability | good | good |
| d) | end face | good | unsatisfactory, partly projecting at the side |
| | | Example 2 (slip) | |
| a) | | good | good |
| b) | | good | good to bad |
| c) | | good | satisfactory, individual wound layers do not run true |
| d) | | good | good in the event of true running |
| | | Example 3 (EVA) | |
| a) | | good | unsatisfactory, protuberances |

TABLE I-continued

| Winding tension controlled according to the invention | | Computer-controlled winder according to EP 0 017 277 |
|---|---|---|
| | | formed because precision of oil hydraulics is insufficient |
| b) | good | good |
| c) | good | good |
| d) | good | good |

While some preferred embodiments of the invention have been illustrated in the drawings and explained in the examples, it is to be understood that the invention is not limited thereto but may be otherwise variously embodied and practiced within the scope of the following claims.

Accordingly, What is claimed is:

1. A method of continuously winding a moving web of a flexible material having two lateral edges onto a sequence of winding cores to form a sequence of web coils each having a generally cylindrical outer surface and two end faces constituted by said lateral edges of said web in said coil, comprising:

guiding said web by a deflection roller first onto a winding drum and subsequently onto a web take-up means where said web coils are formed, said winding drum being provided with a first drive motor for rotating said winding drum and said take-up means being provided with a second drive motor for rotating said web coils on said take-up means and for generating a tensile force acting on said web, said winding drum having a central axis of rotation and a cylindrical contact surface for frictional and essentially non-slipping engagement with said web along a dynamic segment of said contact surface, said segment having a width defined by said edges as well as a length defined by a first line adjacent said take-up means and a second line adjacent said deflection roller, each extending transversely on said contact surface and substantially parallel to said axis of rotation;

continuously monitoring a first value of said tensile force acting upon said web at said first line with a first pressure sensor having a first output related to the first value of tensile force;

continuously monitoring a second value of said tensile force acting upon said web at said second line with a second pressure sensor having a second output related to the second value of tensile force;

comparing said first and second pressure sensor outputs with a comparator to produce a comparison signal; and controlling said second drive motor input by said comparison signal to maintain the first tensile force at a predetermined value to obtain a generally smooth appearance of said cylindrical outer surface and said end faces of said web coils.

2. The method of claim 1 wherein said first line and said second line are located distanced from each other in an essentially horizontal common plane that extends through said axis of rotation of said winding drum.

3. The method of claim 1 wherein said first value of said tensile force is a force acting upon said web between said winding drum and said take-up means and the step of monitoring said first value comprises measuring a net bearing pressure of said winding drum.

4. The method of claim 1, further including the step of maintaining each web coil in surface contact with said winding drum at a controlled linear pressure during at least a portion of a winding cycle.

5. An apparatus for continuously winding a moving web of a flexible material having two lateral edges onto a sequence of winding cores to form a sequence of web coils each having a generally cylindrical outer surface and two end faces constituted by said lateral edges of said web in said coil; said apparatus comprising:

a winding drum having an essentially cylindrical surface for frictional and essentially non-slipping engagement with said web and being operatively connected to a drive motor having a power input, for rotating said winding drum around a central axis;

a deflection roller positioned upstream from and adjacent to said winding drum;

a web take-up means positioned downstream from and adjacent to said winding drum and being operatively connected to a drive motor having a power input, for rotating a winding core on said take-up means;

means for continuously monitoring a first tensile force acting upon said web between said web coil and said winding drum, comprising a first pressure sensor having a first output signal related to the value of the first tensile force;

means for continuously monitoring a second tensile force acting upon said web between said winding drum and said deflection roller, comprising a second pressure sensor having a second output signal related to the value of the second tensile force;

comparator means for controlling said power input of said drive motor of said web take-up means in dependence on said first and second pressure sensor output signals to maintain said first tensile force at a predetermined value.

6. The apparatus of claim 5 wherein said web on said web take-up means is mounted at a relative distance from said winding drum in a vertically supported manner and further including means for altering said relative distance between said winding drum and said web take-up means in response to an increase of diameter of a web coil in said web take-up means.

7. The apparatus of claim 5, further comprising means for coarse positioning said winding drum relative to said web take-up means and means for fine positioning of said winding drum wherein said fine positioning means is a first carriage supporting said winding drum, and said coarse positioning means is a second carriage supporting said first carriage.

8. The apparatus of claim 5, further comprising means for pressing said winding drum against an adjacent surface of said web coil i) at a predetermined linear pressure in the range of from about zero bar to about 10 bar ii) with a maximum deviation from a selected value of less than 30 mbar above or below said selected value independent of a temporary diameter of said web coil that is being wound on said take-up means.

9. The apparatus of claim 8 wherein said means for pressing said winding drum against said surface of said web coil is a membrane cylinder.

10. The apparatus of claim 9 wherein said membrane cylinder is a roll membrane cylinder.

11. The apparatus of claim 5 wherein said means for continuously monitoring said first tensile force is a pressure sensor adapted for measuring the net bearing pressure of said winding drum.

12. The apparatus of claim 11 wherein said means for continuously monitoring said second tensile force is a pressure sensor adapted for measuring the net bearing pressure of said adjacent deflection roller.

13. A process for continuously winding an endless flexible sheet of synthetic material having lateral edges onto a series of winding tubes to constitute a corresponding series of sheet rollers comprising:

guiding said sheet from upstream to downstream by a supporting cylinder and a motor-driven winding drum having an axis and an essentially cylindrical outer surface, onto a motor-driven sheet roller;

maintaining the sheet within an area of said cylindrical outer surface of said winding drum, said area being defined by two distinct generatrices which are parallel to the axis and by said lateral edges of the sheet, and essentially maintaining non-slipping contact with the winding drum;

wherein tensile stress data in the sheet are measured continuously at lines defined by the two generatrices and wherein said stress data are compared to produce an output signal used to control power input to said motor-driven sheet roller to maintain downstream of said winding drum a predetermined tensile stress.

* * * * *